US005564397A

United States Patent [19]

Kleppner et al.

[11] Patent Number: 5,564,397

[45] Date of Patent: Oct. 15, 1996

[54] DEVICE FOR DELIVERING FUEL FROM A FUEL TANK TO THE INTERNAL COMBUSTION ENGINE OF A MOTOR VEHICLE

[75] Inventors: Stephan Kleppner, Bretten; Kurt Frank, Schorndorf; Ansgar Seitz, Neuhausen; Hannelore Scheerer, Moeglingen; Guenter-Paul Ballier, Schwieberdingen; Rolf Fischerkeller, Walheim; Wolfgang Wuerl, Sachsenheim, all of Germany

[73] Assignee: Robert Bosch GmbH, Stuttgart, Germany

[21] Appl. No.: 446,001

[22] Filed: May 19, 1995

[30] Foreign Application Priority Data

Jul. 28, 1994 [DE] Germany ..... 44 26 667.7

[51] Int. Cl.[6] ..... F02M 37/04; F04F 5/00

[52] U.S. Cl. ..... 123/514

[58] Field of Search ..... 123/509, 514; 137/565, 571, 574, 576, 599, 599.1

[56] References Cited

U.S. PATENT DOCUMENTS

| | | | |
|---|---|---|---|
| 4,503,885 | 3/1985 | Hall | 137/474 |
| 4,834,132 | 5/1989 | Sasaki et al. | 137/571 |
| 4,838,307 | 6/1989 | Sasaki et al. | 123/514 |
| 4,860,714 | 8/1989 | Bucci | 123/514 |
| 4,911,134 | 3/1990 | Olsson | 123/514 |
| 4,926,829 | 5/1990 | Tuckey . | |
| 5,133,324 | 7/1992 | Michiaki | 123/510 |
| 5,396,872 | 3/1995 | Rüger et al. | 123/514 |
| 5,452,701 | 9/1995 | Tuckey | 123/509 |

FOREIGN PATENT DOCUMENTS

| | | |
|---|---|---|
| 837336 | 4/1952 | Germany . |
| 3500718 | 7/1986 | Germany . |
| 3732415 | 9/1987 | Germany . |
| 9101313 | 2/1991 | Germany . |
| 4201037 | 1/1992 | Germany . |
| 4153600 | 5/1992 | Japan . |

*Primary Examiner*—Thomas N. Moulis
*Attorney, Agent, or Firm*—Michael J. Striker

[57] ABSTRACT

Arranged in the fuel tank is a reservoir into which fuel is pumped by a jet pump connected to a return line from the internal combustion engine. The jet pump has a jet nozzle which is arranged in a holder formed on the reservoir. Between its inlet opening and the propulsion-nozzle opening, the jet nozzle has a bypass opening which is connected to a stub projecting into the reservoir. At its end, the stub is provided with a seat which can be closed by a closing element. Arranged in the reservoir is a leaf spring which is fixed at one end and which presses the closing element onto the seat. Together with the closing element, the bypass opening forms a bypass valve which allows fuel to flow out of the jet nozzle if a certain pressure is exceeded.

9 Claims, 2 Drawing Sheets

DEVICE FOR DELIVERING FUEL FROM A FUEL TANK TO THE INTERNAL COMBUSTION ENGINE OF A MOTOR VEHICLE

BACKGROUND OF THE INVENTION

The invention starts from the device for delivering fuel from a fuel tank to the internal combustion engine of a motor vehicle.

More particularly, it relates to a device for delivering fuel from a fuel tank to the internal combustion engine of a motor vehicle, which has a reservoir arranged in a fuel tank and having a fuel feed unit drawing in the fuel from the reservoir and connected on the delivery side with the internal combustion engine.

Such a device is known from DE 35 00 718. This device has a reservoir which is arranged in the fuel tank and from which a fuel feed unit draws in fuel and delivers it to the internal combustion engine. Fuel which is not consumed by the internal combustion engine returns to the fuel tank via a return line. Connected to the return line is a jet pump which pumps fuel into the reservoir. The quantity of fuel flowing back through the return line fluctuates considerably depending on the operating state of the internal combustion engine. Thus, the quantity of fuel flowing back is very small during full-load operation of the internal combustion engines while it is very large during idle operation of the internal combustion engine. Depending on the quantity of fuel flowing back, the pressure of the jet pump and the quantity of fuel pumped into the reservoir by the latter also fluctuates considerably, with the result that proper filling of the reservoir by the jet pump is not achieved in all operating states of the internal combustion engine.

SUMMARY OF THE INVENTION

Accordingly, it is an object of the present invention to provide a device for delivering fuel from a fuel tank to the internal combustion engine of a motor vehicle, which avoids the disadvantages of the prior art.

In keeping with these objects and with others which will become apparent hereinafter, one feature of the present invention resides, briefly stated, in a device for delivering fuel from a fuel tank to the internal combustion engine of a motor vehicle, in which the jet pump is assigned a bypass valve through which fuel can flow out of the jet pump into a relief space when a certain pressure in the jet pump is exceeded.

When the device for delivering fuel is designed in accordance with the present invention it has the advantage that the pressure in the jet pump is kept at least virtually constant by the bypass valve and that the reservoir is correctly filled by the jet pump irrespective of the quantity of fuel flowing back through the return line.

In accordance with another feature of the present invention, the holder for the jet nozzle is formed integrally on the reservoir. The integration of the jet pump into the reservoir permits a particularly simple jet pump construction.

Still another feature of the present invention, is that a leaf spring is fixed at one end and arranged within the reservoir as the spring element loading the closing element. These features permit a simple bypass valve construction.

Still another feature of the present invention is that the jet nozzle has in its outer circumference an encircling annular groove into which the bypass opening opens and which is connected to the stop or opening of the holder. These features allow a simple installation of the jet nozzle since it can be installed in any rotational position desired and a connection between the bypass opening and the stub is in all cases ensured by the annular groove.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
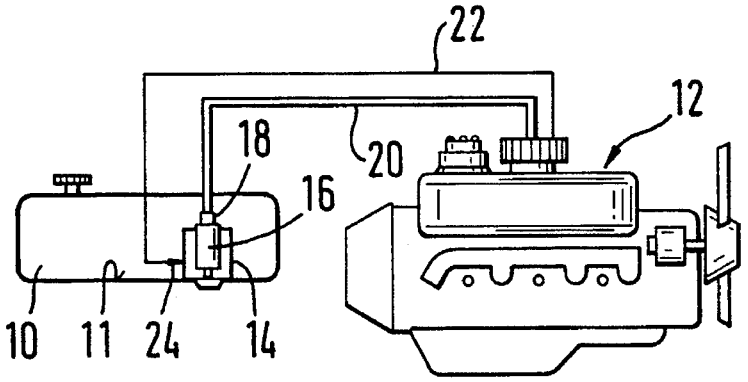
FIG. 1 shows a device for delivering fuel from the fuel tank to the internal combustion engine of a motor vehicle in simplified representation.

FIG. 1 shows, in simplified diagrammatic form, a device which serves to deliver fuel from a fuel tank 10 to the internal combustion engine 12 of a motor vehicle. Arranged in the fuel tank 10 is a reservoir 14 from which a fuel feed unit 16 arranged in the reservoir 14 draws in fuel. Connected to a delivery stub 18 and the fuel delivery unit 16 is a delivery line 20 which leads to the internal combustion engine pressure 12. Leading back from the internal combustion engine 12 to the fuel tank 10 there is furthermore a return line 22 through which excess fuel not used by the internal combustion engine 12 flows back into the fuel tank 10. Connected to the return line 22 is a jet pump 24 which is arranged within the fuel tank 10 and through which fuel is pumped into the reservoir 14. During the operation of the internal combustion engine 12, the fuel feed unit 16 pumps fuel out of the reservoir 14 to the internal combustion engine 12 and the fuel flowing back through the return line 22 drives the jet pump 24.

Figure 2:
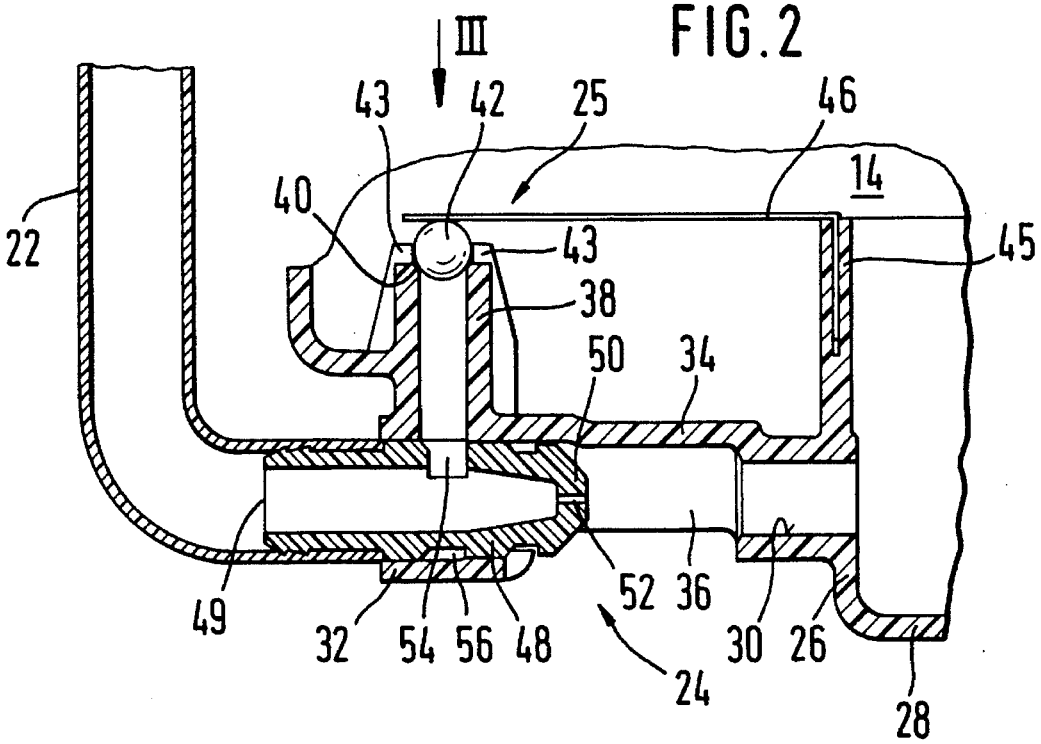
FIG. 2 shows a jet pump with a reservoir of the device in FIG. 1 in accordance with the first exemplary embodiment.

In FIG. 2, the fuel tank 10 and the reservoir 14 are depicted only partially, the fuel feed unit (not shown) being arranged in the reservoir 14, as is a bypass valve 25, assigned to the jet pump 24, in accordance with a first exemplary embodiment. The reservoir 14, which is preferably composed of plastic, is arranged close to the bottom 11 of the fuel tank 10 and is secured in the fuel tank 10 in a manner not shown. In a lateral wall 26 of the reservoir 14, just above the bottom 28 of the latter, there is an opening 30, through which the interior of the reservoir 14 is connected to the fuel tank 10. A hollow, approximately cylindrical holder 32 is formed integrally on the reservoir 14 at a distance from the opening 30. This holder is arranged approximately coaxially to the opening 30 and is of circular design in cross-section but can also be of any other desired design, for example rectangular. The cross-section of the holder 32 is larger than that of the opening 30. Between the holder 32 and the opening 30, the reservoir 14 has a wall part 34 which runs approximately horizontally above the opening 30. A channel 36 opens outward into the fuel tank 10 is formed in the downward-facing outer side of the wall part 34. A stub 38 which opens into the holder 32 projects from the wall part 34 into the interior of the reservoir 14 in the region of the holder 32.

Figure 3:
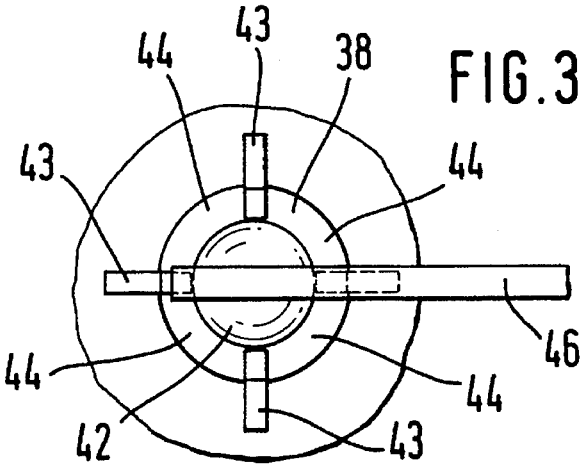
FIG. 3 shows a partial view in the direction of arrow III in FIG. 2.

At its end arranged in the reservoir 14, the stub 38 is provided with a seat 40 with which a closing element 42, in the form of a ball for example, interacts. The seat 40 is designed in such a way that it widens conically towards the interior of the reservoir 14. A guide for the closing element 42 is formed adjoining the seat 40 into the interior of the reservoir 14, this guide being formed by a plurality of webs 43, depicted in FIG. 3, which are arranged at a distance apart around the circumference of the stub 38. The closing element 42 is guided between the webs 43 but fuel can flow through the interspace 44 between the webs when the closing element 42 is raised from the seat 40. A spring element 46 in the form of a leaf spring is fixed at one end on a support 45 projecting into the reservoir 14, the other, free end of the spring acting on the closing element 42 and pressing it against the seat 40. A spring element of any other desired design can also be used for the closing element 42 instead of the leaf spring 46.

A jet nozzle 48 of the jet pump 24 can be introduced into the holder 32 from the side facing away from the opening 30, the said jet nozzle preferably being composed of plastic. One end of the jet nozzle 48 including the inlet opening 49 of the latter projects from the holder 32 on the side facing away from the opening 30 and the return line 22 is pushed onto this end. In its region pointing towards the return line 22, the jet nozzle 48 has the inlet opening 49 of essentially constant cross-section and, in its end region pointing towards the opening 30, the free cross-section in the jet nozzle 48 tapers. In the end wall 50 of the jet nozzle 48 pointing towards the opening 30, there is only the outlet or propulsion-nozzle opening 52, which has a considerably smaller cross-section. That end of the jet nozzle 48 which points towards the opening 30 projects somewhat from the holder 32 into the channel 36. In the region from which its cross-section tapers, the jet nozzle 48 is provided in its circumference with a bypass opening 54. Formed in the outer circumference of the jet nozzle 48 is an encircling annular groove 56 into which the bypass opening 54 opens and, with the jet nozzle 48 arranged in the holder 32, is arranged in such a way that the stub 38 opens into it. The annular groove 56 is provided in order to permit simple installation of the jet nozzle 48 in the holder 32, since the annular groove 56 ensures the connection of the bypass opening 54 to the pipe stub 38 at all times irrespective of the rotational position of the jet nozzle about its longitudinal axis.

Together with the spring-loaded closing element 42 which closes the stub 38, the bypass opening 54 forms the bypass valve 25 through which fuel can flow out of the jet nozzle 48 into the reservoir 14 as a relief space when the pressure caused in the jet nozzle 48 by the fuel flowing back through the return line 22 exceeds a certain value sufficient to raise the closing element 42 from the seat 40 counter to the force of the spring element 46. The holder 32 for the jet nozzle 48 is formed integrally with the reservoir 14. Instead of flowing off into the reservoir 14, the fuel flowing out of the jet nozzle 4 through the bypass valve 25 could also flow off into the fuel tank 10 as the relief space. The fuel emerging from the jet nozzle 48 through the propulsion-nozzle opening 52 takes with it or entrains fuel from the fuel tank 10 through the open channel 36 and this fuel is conveyed through the opening 30 into the reservoir 14, with the result that there is always enough fuel in the reservoir 14 for the fuel feed unit 16. The fuel flowing off through the bypass valve 25 likewise passes into the reservoir 14 but without additionally taking fuel with it from the fuel tank.

Figure 4:
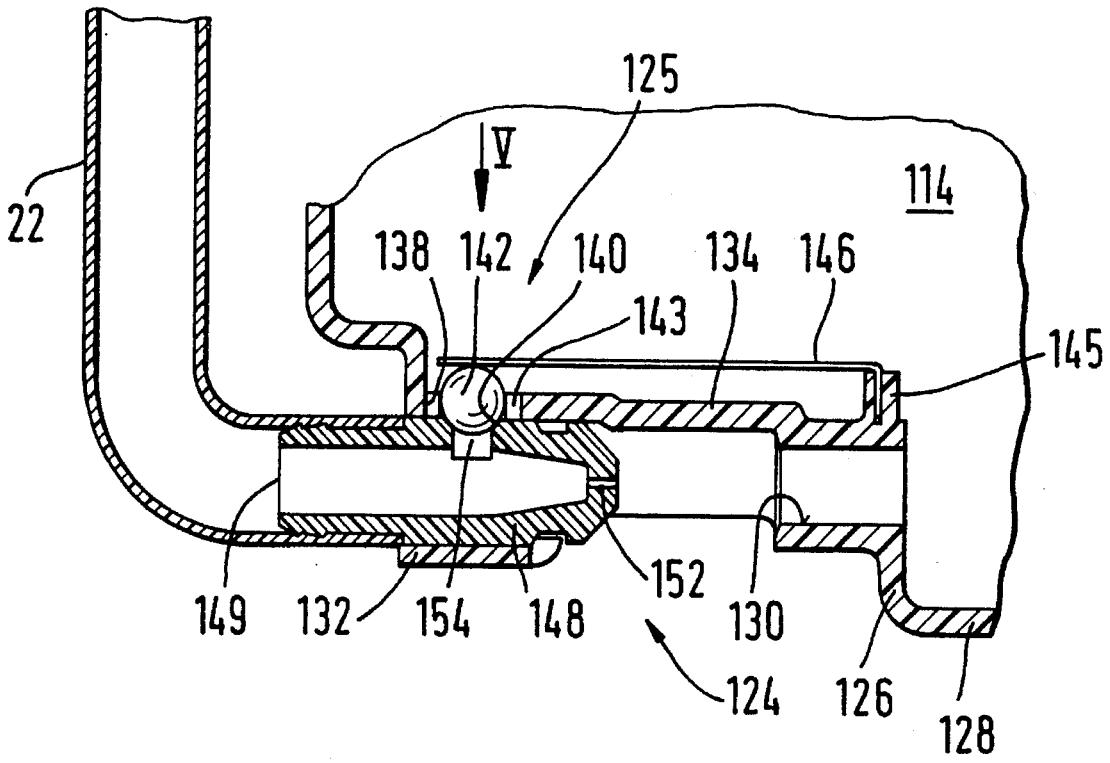
FIG. 4 shows the jet pump with the reservoir in accordance with a second exemplary embodiment.
Figure 5:
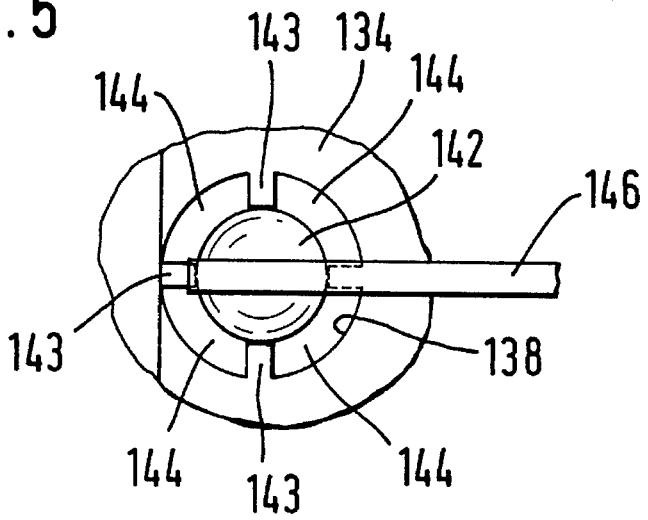
FIG. 5 shows a partial view in the direction of arrow V in FIG. 4.

FIG. 4 shows a second exemplary embodiment of the bypass valve 125, in which the basic construction of the jet pump 124 and of the reservoir 114 is essentially the same as that described above in the case of the first exemplary embodiment. The opening 130 is arranged just above the bottom 128 of the plastic reservoir 114 in the lateral wall 126 of the latter, and the holder 143—designed as in the first exemplary embodiment—for the jet nozzle 148 is arranged on the wall part 134 of the reservoir 114. The wall part 134 has an opening 138 by means of which the interior of the reservoir 114 is connected to the holder 132. The jet nozzle 148, which is composed of plastic, has the inlet opening 149 assigned to the returnline 22, the outlet—or propulsion-nozzle opening 152 and, at its circumference, the bypass opening 154, the mouth of which at the outer circumference of the jet nozzle 148 widens conically, being designed as a seat 140 for the closing element 142. Projecting radially inwards from the opening 138, around the circumference of the latter, are webs 143 (depicted in FIG. 5) which are arranged at a distance apart and between the ends of which the closing element 142 is guided. With the closing element 142 raised from the seat 140, fuel can flow in! to the reservoir 114 through the interspaces 144 between the webs 143. As in the first exemplary embodiment, the spring element 146 for the closing elements 142 is arranged in the reservoir 114 and is designed as a leaf spring fixed at one end on the support 145 which projects into the reservoir 114.

It will be understood that each of the elements described above, or two or more together, may also find a useful application in other types of constructions differing from the types described above.

While the invention has been illustrated and described as embodied in a device for delivering fuel from a fuel tank to the internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for delivering fuel from a fuel tank to an internal combustion engine of a motor vehicle, comprising a reservoir arrangeable in a fuel tank and formed as said relief space; a fuel feed unit drawing in fuel from said reservoir and connectable on a delivery side of an internal combustion engine; a return line extendable from the internal combustion engine to said fuel tank; a jet pump connected to said return line and arrangeable in the fuel tank so as to pump fuel into said reservoir; a bypass valve which is assigned to said jet pump and through which fuel can flow out of said jet pump into said relief space when a certain pressure in said jet pump is exceeded, said jet pump having a jet nozzle with an inlet opening assigned to said return line, an outlet opening, and a bypass opening provided on a circumference of said jet nozzle between said inlet opening and said outlet opening; a spring-loaded closing element which controls a connection of said bypass opening to said relief space in order to form said bypass valve; a holder for holding said jet nozzle, said holder surrounding said jet nozzle at said circumference of said jet nozzle and having an opening arranged in the region of said bypass opening, said bypass opening having a mouth located at said outer circumference of said jet nozzle and formed as a seat with which said closing element interacts, said holder for said jet nozzle being formed integrally on said reservoir; and a leaf spring having one end which is fixed to and arranged within said reservoir to form a spring element which loads said closing element.

2. A device as defined in claim 1; and further comprising a holder provided for holding said jet nozzle and surrounding said jet nozzle at said circumference of said jet nozzle, said holder having a stop which is connected to said bypass opening and has a seat with which said closing element interacts.

3. A device as defined in claim 1, wherein said jet nozzle is provided on said outer circumference with an encircling annular groove into which said bypass opening opens and which is connected to said holder.

4. A device as defined in claim 3, wherein said holder has a stop with which said annular groove is connected.

5. A device as defined in claim 3, wherein said holder has an opening with which said annular groove is connected.

6. A device as defined in claim 2, wherein said jet nozzle is provided on said outer circumference with an encircling annular groove into which said bypass opening opens and which is connected to said holder.

7. A device as defined in claim 6, wherein said holder has a stop with which said annular groove is connected.

8. A device as defined in claim 6, wherein said holder has an opening with which said annular groove is connected.

9. A device for delivering fuel from a fuel tank to an internal combustion engine of a motor vehicle, comprising a reservoir arrangeable in a fuel tank and formed as said relief space; a fuel feed unit drawing in fuel from said reservoir and connectable on a delivery side of an internal combustion engine; a return line extendable from the internal combustion engine to said fuel tank; a jet pump connected to said return line and arrangeable in the fuel tank so as to pump fuel into said reservoir; a bypass valve which is assigned to said jet pump and through which fuel can flow out of said jet pump into said relief space when a certain pressure in said jet pump is exceeded, said jet pump having a jet nozzle with an inlet opening assigned to said return line, an outlet opening, and a bypass opening provided on a circumference of said jet nozzle between said inlet opening and said outlet opening; a spring-loaded closing element which controls a connection of said bypass opening to said relief space in order to form said bypass valve; a holder provided for holding said jet nozzle and surrounding said jet nozzle at said circumference of said jet nozzle, said holder having a stop which is connected to said bypass opening and has a seat with which said closing element interacts, said jet nozzle being formed integrally on said reservoir; and a leaf spring having one end which is fixed to and arranged within said reservoir to form a spring element which loads said closing element.

* * * * *